US006253557B1

(12) United States Patent
Credle, Jr.

(10) Patent No.: US 6,253,557 B1
(45) Date of Patent: Jul. 3, 2001

(54) ICE BANK DETECTOR

(75) Inventor: William S. Credle, Jr., Stone Mountain, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/166,024

(22) Filed: Oct. 5, 1998

(51) Int. Cl.[7] ..... F25C 1/08
(52) U.S. Cl. ..... 62/59; 62/139
(58) Field of Search ..... 62/59, 138, 139

(56) References Cited

U.S. PATENT DOCUMENTS

| | | | | |
|---|---|---|---|---|
| 1,999,191 | | 4/1935 | Hirschl | 62/4 |
| 2,187,258 | * | 1/1940 | Wood | 62/59 |
| 2,421,819 | | 6/1947 | Vandenberg | 62/4 |
| 2,724,950 | * | 11/1955 | Rothwell | 62/59 |
| 2,974,630 | * | 3/1961 | Kriechbaum | 62/139 |
| 3,502,899 | * | 3/1970 | Jones | 62/139 |
| 4,124,994 | | 11/1978 | Cornelius et al. | 62/138 |
| 4,199,956 | | 4/1980 | Lunde | 62/138 |
| 4,346,564 | | 8/1982 | Gemma et al. | 62/140 |
| 4,480,441 | * | 11/1984 | Schulze-Berge et al. | 62/138 |
| 4,497,179 | | 2/1985 | Iwans | 62/59 |
| 4,551,982 | | 11/1985 | Kocher et al. | 62/130 |
| 4,638,640 | | 1/1987 | Whetstone et al. | 62/139 |
| 4,860,551 | | 8/1989 | Query | 62/140 |
| 4,873,510 | | 10/1989 | Khurgin | 340/580 |
| 4,934,150 | | 6/1990 | Fessler | 62/59 |
| 5,022,233 | | 6/1991 | Kirschner et al. | 62/138 |
| 5,585,551 | | 12/1996 | Johansson et al. | 73/64.53 |
| 5,606,864 | | 3/1997 | Jones | 62/139 |
| 5,627,310 | | 5/1997 | Johnson | 73/64.53 |
| 5,732,563 | | 3/1998 | Bethuy et al. | 62/139 |

FOREIGN PATENT DOCUMENTS

| | | |
|---|---|---|
| 30 07 472 A1 | 9/1981 | (DE) . |
| 865214 | 1/1957 | (GB) . |
| 1 420 337 | 1/1976 | (GB) . |
| 0 517 2374 | 9/1993 | (JP) . |

OTHER PUBLICATIONS

Danfoss, "Evaporators for Refrigeration Appliances" (undated).

* cited by examiner

*Primary Examiner*—William E. Tapolcai
(74) *Attorney, Agent, or Firm*—Sutherland Asbill & Brennan, LLP

(57) ABSTRACT

An ice detector for an ice water bath tank having an evaporator system operated by a compressor to promote the growth of ice therein. The detector includes a device for providing reciprocating motion and a probe connected to the device. The probe is capable of reciprocating movement within the ice water bath tank until a predetermined amount of ice grows adjacent to the probe.

27 Claims, 4 Drawing Sheets

ICE BANK DETECTOR

TECHNICAL FIELD

The present invention relates generally to a beverage dispensing apparatus with an ice water bath tank therein and more particularly relates to a detector for sensing ice growth within the ice water bath tank.

BACKGROUND OF THE INVENTION

Beverage dispensing systems commnonly use an internal ice bank to cool the beverage to a predetermined temperature before the beverage is served to a customer. An example of a known beverage dispensing system with an internal ice bank is shown in commonly-owned U.S. Pat. No. 5,022,233 to Kirschner, et al., entitled "Ice Bank Control System for a Beverage Dispenser." As is shown in this reference and in FIG. 1 herein, a beverage dispenser 10 may use a mechanical refrigeration system 12. The refrigeration system 12 includes an ice water bath tank 14, a plurality of evaporator coils 16 positioned in the tank 14 to build an ice bank 17, a plurality of syrup cooling coils 18, a plurality of water cooling coils 19, an agitator 20, an agitator motor 22, and a compressor or an evaporator system including a compressor motor 24 and a control box 26 housing an ice bank control system 28.

In use, syrup and water passing through the syrup coils 18 and the water coils 19 are chilled by the ice of the ice bank 17. The ice is created by the compressor system removing heat from the water in the ice water bath tank 14. The compressor system may use the plurality of evaporator coils 16 as is shown, one or more evaporator plates of roll-bond construction, or other conventional means of removing heat. The evaporator coils 16 or the evaporator plates are powered by the compressor motor 24. Operation of the compressor motor 24 is controlled by the ice bank control system 28. The ice bank control system 28 monitors the growth of the ice bank 17 so as to run the compressor motor 24 until a predetermined amount of ice has developed. If too much ice grows, the syrup and water coils 18, 19 may freeze. After the compressor motor 24 is shut down, the ice bank control system 25 may again turn on the compressor motor 24 after a predetermined interval to prevent the ice bank 17 from deteriorating. In one embodiment, this reference discloses the use of a thermistor sensing element 30 positioned at a predetermined distance from the evaporator coils 16. The ice bank control system 25 therefore turns the compressor motor 24 off when the sensor 30 detects the presence of a predetermined amount of ice. U.S. Pat. No. 5,022,233 is incorporated herein by reference.

A similar ice bank control system is shown in commonly-owned U.S. Pat. No. 4,4907,179, entitled "Ice Bank Control System for Beverage Dispenser." This reference uses a pair of sensors to determine the growth of the ice bank at predetermined positions spaced from the evaporator coils. U.S. Pat. No. 4,4907,179 is also incorporated herein by reference. Other known ice bank devices use various types of mechanical and electrical sensors, oscillation frequencies, and even optics to detect the growth of ice. In each of these systems, the compressor runs and promotes the growth of ice within the ice bank until the control system determines that a sufficient amount of ice has been made. At that point, the control system turns the compressor off until a predetermined length of time elapses, the ice bank shrinks to a predetermined size, or some other predetermined variable is reached.

Although the purpose of an ice bank detector is to control the refrigeration system such that as much ice as possible grows without freezing the product cooling lines, known detectors only detect the growth of ice at one point in the ice bank. Such detectors, therefore, are not always reliable when, for example, ice bank erosion occurs or when the refrigeration units are improperly charged. These conditions can result in uneven ice growth across the ice bank. For example, FIG. 2 shows the typical shape of an ice bank 50 with a low or an uneven refrigeration charge. As is shown, significant ice growth occurs at the bottom of the ice bank 50 with a much smaller amount of ice growth at the top. The detector 60, however, is positioned at the top of the ice bank 50 and would not detect the ice at the bottom of the ice bank 50. The result is that the compressor would continue to run and cause the ice bank 50 in the bottom of the tank to freeze the product lines 70 well before the detector 60 sensed the presence of the ice bank 50.

What is needed, therefore, is an ice bank detector that monitors the growth of ice across a significant portion of the entire ice bank. Such a device would accurately determine the growth of ice throughout the ice bank regardless of uneven ice growth or erosion. Such a detector must accomplish these goals in a reliable and cost effective manner.

SUMMARY OF THE INVENTION

The present invention provides an ice detector for an ice water tank having an evaporator system operated by a compressor to promote the growth of ice therein. The detector includes a device for providing reciprocating motion and a probe connected to the device. The probe is capable of reciprocating movement within the ice water tank until a predetermined amount of ice grows adjacent to the probe.

Specific embodiments of the present invention include the use of an electrical device such as a solenoid as the device. The probe is positioned within the ice water tank and may include a plurality of members extending towards the evaporator system. The probe may be made of a substantially rigid material. The probe may have an elongated member extending in a direction substantially parallel to the evaporator system. The plurality of members extending towards the evaporator system, or the flanges, may be positioned along this elongated member.

Alternatively, the probe may have a plurality of spokes extending from the elongated member towards an outer hub, with the plurality of members extending towards the evaporator system positioned on the spokes and the outer hub. Further, the probe may have a first probe connected to the device and positioned on a first side of the evaporator system, a linkage connected to the first probe, and a second probe connected to the linkage and positioned on a second side of the evaporator system. The probe also may be made of a flexible material. The probe may then include an elongated member extending in a direction substantially parallel to the evaporator system and further extending in a direction substantially perpendicular to the evaporator system. In any of these embodiments, the detector may detect the growth of ice over an extended length of the ice water tank.

The ice detector also may have a contact sensor positioned adjacent to the probe for contact therewith. The contact sensor may be in communication with the compressor such that the compressor remains operative when the probe contacts the contact sensor during the reciprocating movement. Likewise, the compressor may be shut down when the probe fails to contact the contact sensor because the predetermined amount of ice has grown adjacent to any of the plurality of probe members. Similarly, the probe may move between a first position in contact with the contact sensor and a second position spaced a predetermined distance from the contact sensor. The compressor may be shut down when the probe contacts the contact sensor at the first position but fails to travel to the second position because the predetermined amount of ice has grown adjacent to any of the plurality of probe members. The probe also may have a collar with a contact flange thereon such that the collar connects the probe to the device and also contacts the contact sensor during the reciprocating movement.

In another embodiment, the present invention provides an improved refrigeration system for a beverage dispenser. Such a refrigeration system includes a compressor, an ice water tank, a plurality of evaporator tubes positioned within the ice water tank to promote the growth of ice, and an ice probe positioned within the ice water tank. The ice probe includes at least one member extending in a direction parallel to the plurality of evaporator coils and a plurality of second members extending in a direction substantially perpendicular to the plurality of said evaporator coils. The refrigeration system further includes means for controlling the compressor such that the compressor is deactivated when ice builds up adjacent to the ice probe. Alternatively, one or more evaporator plates may be used instead of the evaporator coils.

The method of the present invention detects the buildup of ice in an ice bank. The ice bank includes a plurality of evaporator tubes or plates operated by a compressor and positioned within a water tank. The method includes the steps of placing an ice probe within the water tank adjacent to one or more of the plurality of evaporator tubes or channels. The ice probe includes a plurality of members positioned thereon. The method further includes the steps of cycling the ice probe between a first and a second position in reciprocating motion, determining if the ice probe has completed the cycling step, running the compressor if the cycling step is completed, and stopping the compressor if the cycling step is not completed because any of the plurality of probe members are embedded in the ice.

It is thus an object of the present invention to provide an improved ice bank detector.

It is an another object of the present invention to provide an improved ice bank detector for use with a beverage dispensing system.

It is a further object of the present invention to provide an ice bank detector that detects ice growth at several locations within the ice bank.

It is yet another object of the present invention to provide an ice bank detector that detects ice growth across the entire ice bank.

It is a still further object of the present invention to provide an ice bank detector that detects ice growth even cases of ice bank erosion or low refrigeration levels.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
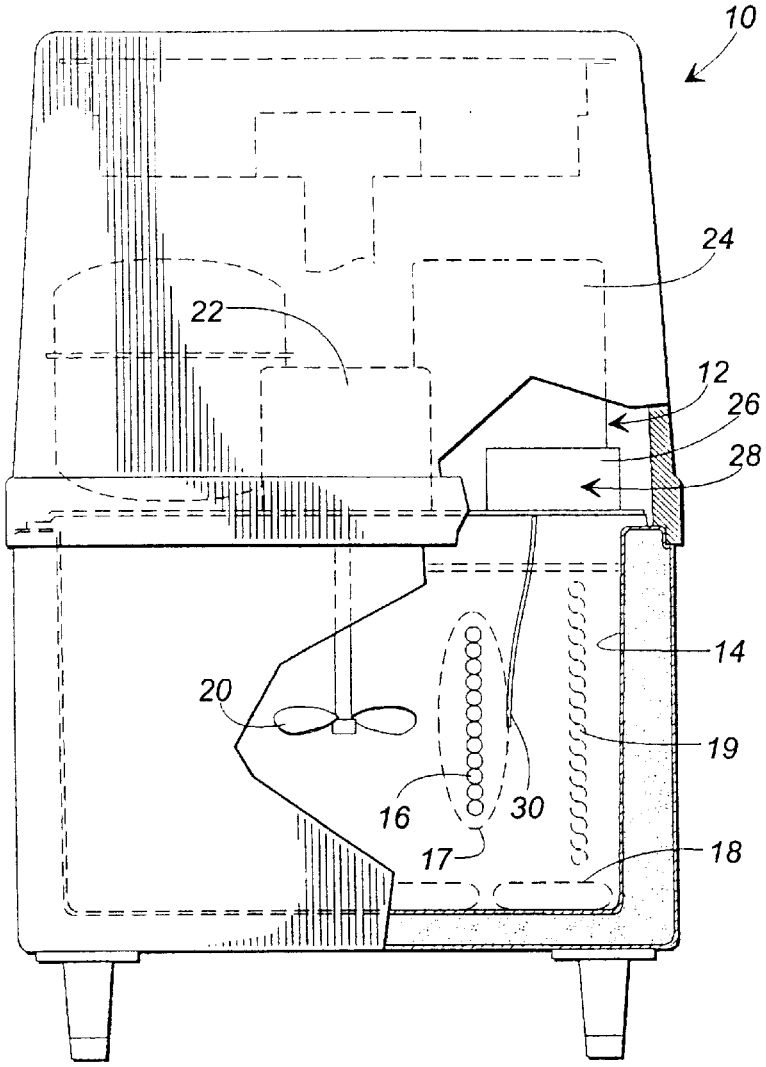
FIG. 1 (PRIOR ART)
FIG. 1 is an elevational view, partially in section, of a prior art beverage dispenser including a water bath and a mechanical refrigeration unit.
Figure 2:
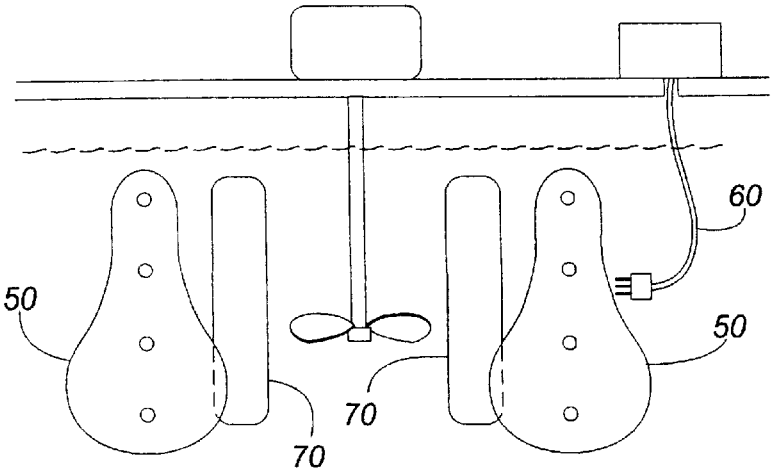
FIG. 2 (PRIOR ART)
FIG. 2 is a side cross-sectional view of a prior art refrigeration unit having an ice bank formed with a low refrigeration charge.
Figure 3:
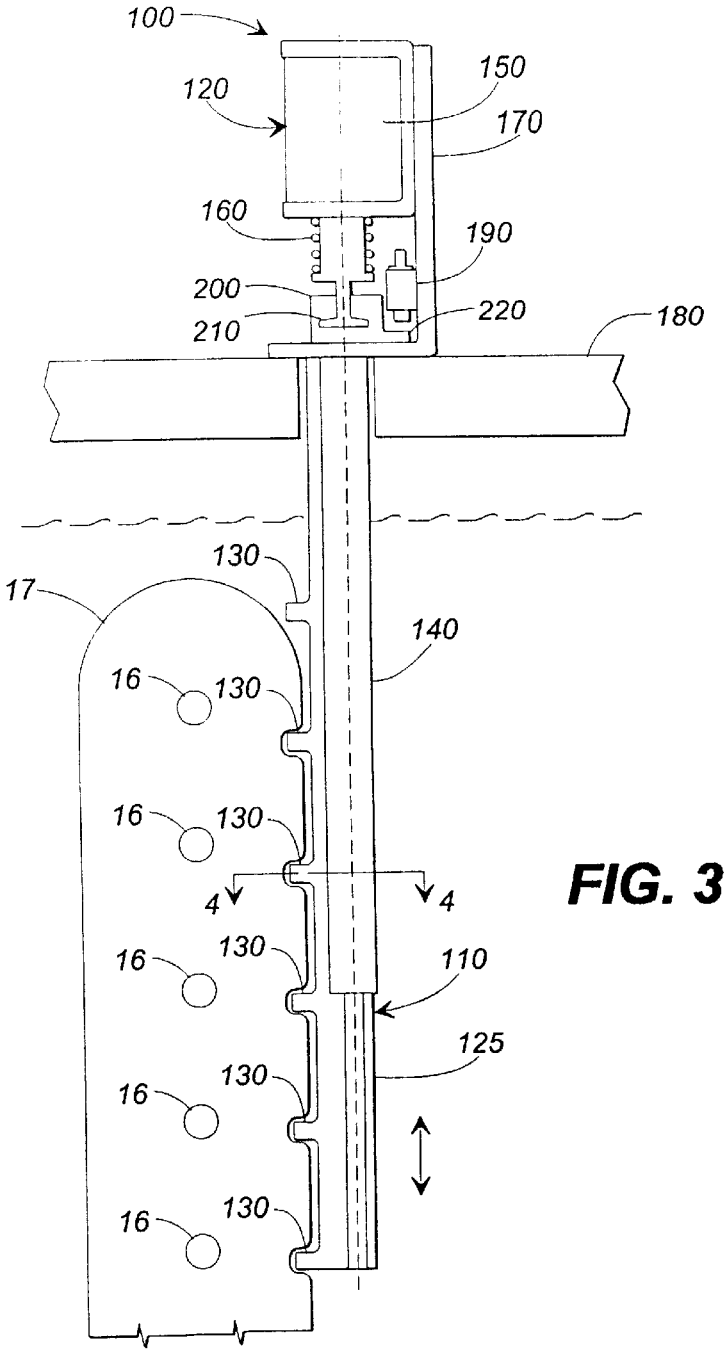
FIG. 3 is a perspective view of the ice bank detector of the present invention.
Figure 4:
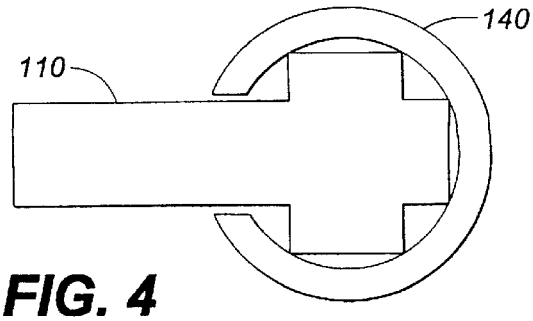
FIG. 4 is a top cross-sectional view taken along line 4—4 of FIG. 3.

Referring now in more detail to the drawings, in which like numerals refer to like parts throughout the several views, FIGS. 3 and 4 show an ice bank detector 100 of the present invention. The ice bank detector 100 is designed for use with the beverage dispenser 10 as described in FIG. 1 or any conventional type of beverage dispenser using an internal ice water bath tank. The ice bank detector 100 includes a probe 110 operably connected to a reciprocating device such as a solenoid 120. The probe 110 may be a vertically extending member 125. The probe 110 is preferably made from a substantially rigid plastic such as nylon, acetal, or ABS (Acrylonitrile, Butadiene, and Styrene). Alternatively, metal, glass, or other substantially rigid, non-corrosive materials may be used.

The probe 110 also may have a plurality of horizontally extending flanges 130 thereon. By the terms "horizontally" and "vertically", we mean the respective relative positions of the elements, i.e., the horizontally extending flanges 130 are positioned substantially perpendicular to the vertically extending member 125, as opposed to absolute positions. The flanges 130 extend horizontally towards the one or more of the evaporator coils 16 or the evaporator plate of the beverage dispenser 10. Any number of the flanges 130 may be used or the vertically extending member 125 may be used without the flanges 130. Likewise, the flanges 130 may be the rectangular structures of FIG. 3 in any size, raised ribs of any size, or any conventional size and shape. In the present embodiment, the flanges 130 are spaced essentially equally along the length of the vertically extending member 125.

The probe 110 is slidably positioned within a vertically extending jacket 140. The jacket 140 is preferably made of plastic, non-corrosive metals, or similar materials. A cross-sectional view of the probe 110 within the jacket 140 is shown in FIG. 4. As is shown, the probe 110 is preferably "T"-shaped in cross-section for ease of vertical movement within the jacket 140. In this embodiment, the probe 110 may be about seven inches long with six flanges 130 evenly spaced along the bottom five inches of the vertically extending member 125. The flanges 130 preferably are about 0.1 inches in length and width and extend outward about 0.2 inches from the vertically extending member 125. The size of the probe 110 and the flanges 130 may depend upon the size of the beverage dispenser 10 and other factors.

The solenoid 120 may be a conventional solenoid used for providing reciprocating motion. The solenoid 120 includes a conventional electric coil 150 connected to a plunger 160 for vertical motion therewith as is well known to those skilled in the art. The solenoid 120 may generate about two pounds of force when raising the probe 110. The amount of force generated by the solenoid 120 may depend upon the size of the beverage dispenser 10 and other factors. Alternatively, other types of reciprocating devices may be used. These devices include other types of electrical devices, such as a conventional DC electric motor or an agitator motor. The reciprocating device also may include pneumatic devices, mechanical devices, or similar types of mechanisms known to those skilled in the art to provide the reciprocating motion to the probe 110.

The solenoid 120 is mounted within a rigid frame 170. The frame 170 is fixedly attached to a refrigeration deck 180 of the beverage dispenser 10. The frame 170 of the ice bank detector 100 is mounted on the refrigeration deck 180 such that the probe 110 is positioned at a predetermined distance from one or more of the evaporator coils 16 or the evaporator plates. The frame 170 is attached to the refrigeration deck 180 by snaps or other conventional means. The frame 170 is preferably made from plastic, non-corrosive metals, or similar materials. The probe jacket 140 may be a unitary part of the frame 170 or the jacket 140 and the frame 170 may be fixedly attached by conventional means. The probe jacket 140 extends downward from the refrigeration deck 180 towards the evaporator coils 16 or evaporator plates.

Also mounted to the frame 170 is a sensor such as a contact sensor 190. The contact sensor 190 is a conventional electric switch or similar mechanism that breaks or creates an electrical circuit when contacted. Other conventional types of control circuits known to those skilled in the art also may be used. For example, other sensing devices such as a photoelectric eye, a Hall effect sensor, or a current change sensor may be used. The contact sensor 190 is in communication with the ice bank control system 28 as described above. The ice bank control system 28 controls the operation of the compressor 24 based upon the input from the ice bank detector 100.

The probe 110 is connected to the solenoid 120 by a collar 200. The collar 200 preferably is an integral element of the probe 110 and is molded or formed as a single piece therewith. Alternatively, the collar 200 may be a separated element and fixedly attached to the probe 110 by conventional means. The collar 200 has a groove 210 formed therein so as to accommodate the plunger 160 of the solenoid 120. The collar 200 also has a contact flange 220 positioned adjacent to the contact sensor 190 such that the contact flange 220 hits the contact sensor 190 when the probe 110 is raised by a predetermined amount.

In use, the solenoid 120 lifts the probe 110 intermittently to check for ice growth within the ice water bath tank 14 surrounding the evaporator coils 16 or the evaporator plates. If the solenoid 120 lifts the probe 110 until the contact flange 220 of the collar 200 hits the contact sensor 190, a sufficient amount of ice is not present, i.e., a predetermined amount of ice would surround the probe 110 and the flanges 130 so as to prevent the probe 110 from moving. The compressor motor 24 therefore continues to operate. If the solenoid 120 cannot lift the probe 110 because the probe 110 is embedded in the ice, the contact flange 220 of the collar 200 does not contact the contact sensor 190. The failure to hit the contact sensor 190 informs the control system 28 to shut off the compressor motor 24. Similarly, if the collar 200 of the probe 110 hits the contact sensor 190, but does not return to its lower position, the control system also shuts down the compressor motor 24.

The cycling rate of the detector 100 may be varied based on how fast the refrigeration system 12 builds the ice bank 17. The cycling rate after the ice bank 17 is built may be different from the rate before the ice is built. Once the control system 28 shuts the compressor motor 24 down because a sufficient amount of ice has grown, the control system 28 may again turn on the compressor motor 24 in a manner known in the art so as to prevent the erosion of the ice bank 17. The control system 28 may turn the compressor motor 24 on after a predetermined amount of time or based upon other types of variables. Preferably, the compressor motor 24 will be turned on as soon as the probe 110 can move again.

Figure 3A:
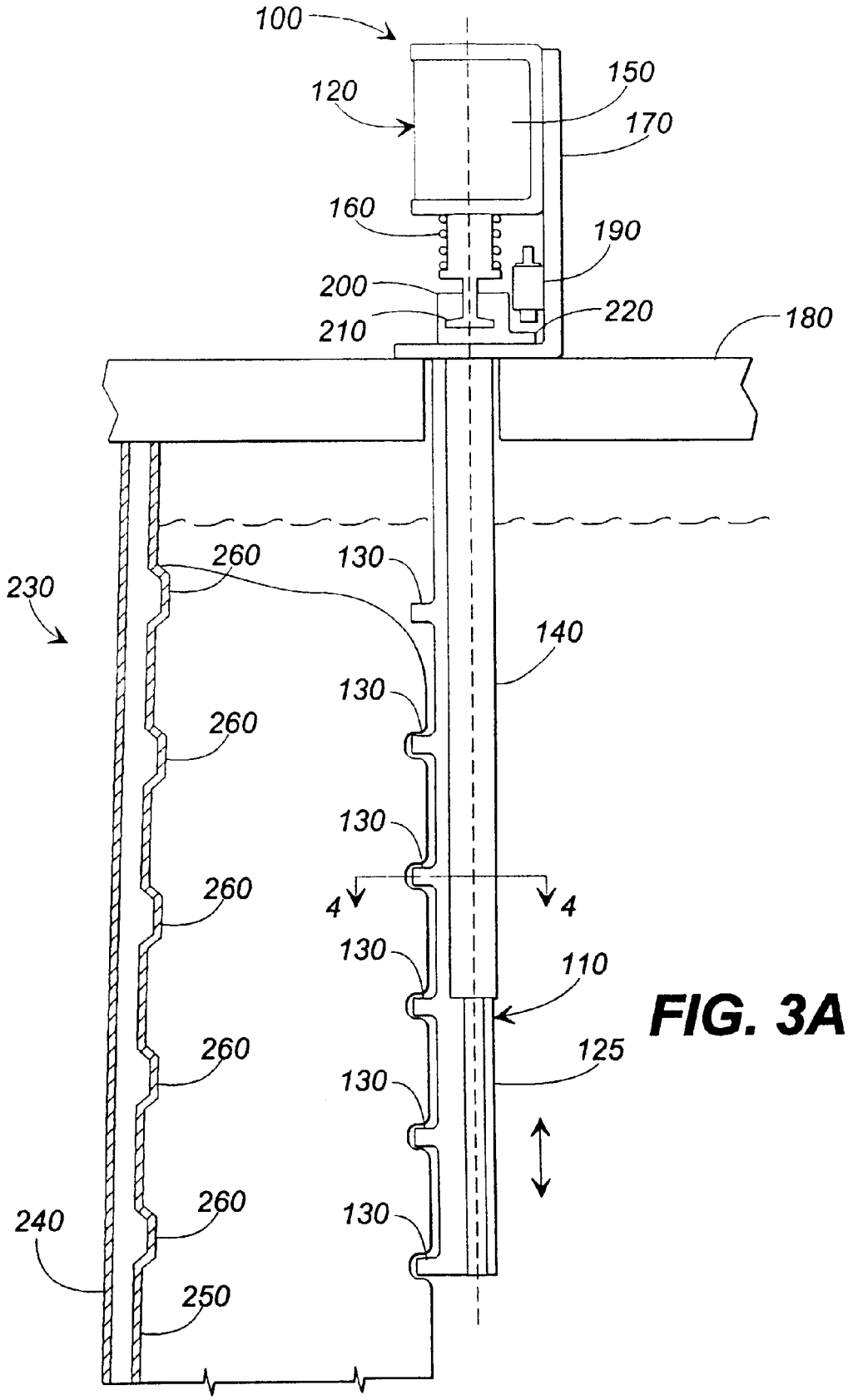
FIG. 3A is a perspective view of the ice bank detector of the present invention using an evaporator plate.

FIG. 3A shows the use of the same detector 100 as in FIG. 3 in the refrigeration system 12 using one or more evaporator plates 230 as opposed to the evaporator coils 16 described above. The evaporator plates 230 may be formed by two aluminum sheets 240, 250 produced by the roll-bond principle. The evaporator plates 230 may include a series of evaporator channels 260 therein. Four evaporator plates 230 may be assembled in the shape of a square and positioned within the ice water bath tank 14. A preferred evaporator sheet is manufactured by Danfoss A/S of Nordborg, Denmark. As with the previous embodiment, the detector 100 is positioned a predetermined distance from the evaporator plates 230.

Figure 5:
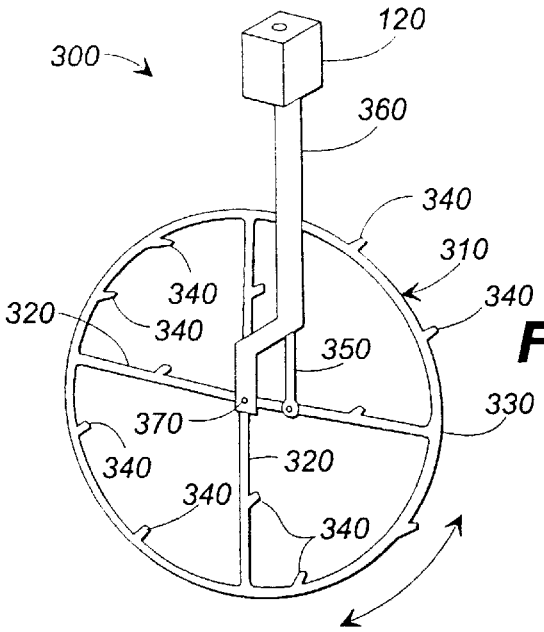
FIG. 5 is a perspective view of an alternative embodiment of the present invention showing a circular ice bank probe.

FIG. 5 shows an alternative embodiment of the present invention. This figure shows an ice bank detector 300 having a circular probe 310. The probe 310 has a plurality of spokes 320 connected to a hub or an outer wheel 330. Both the plurality of the spokes 320 and the outer wheel 330 may have a plurality of flanges 340 extending horizontally towards the evaporator system (not shown).

As with the previous embodiment of FIG. 3, this embodiment also uses the solenoid 120 and the contact sensor 190 mounted within the frame 170. In this case, the probe 310 is connected to the solenoid 120 by a rod 350. The rod 350 is connect to the solenoid 120 by the collar 200 or by similar means. The rod 350 is also connected to one of the spokes 320 of the probe 310. The rod 350 is encased within a jacket 360 for vertical movement therein. The jacket 360 also is connected to the probe 310 at an axle 370.

In use, the solenoid 120 raises the rod 350 such that the probe 310 rotates about the axle 370 by at least several degrees. As with the first embodiment, when the collar 200 hits the contact sensor 190, the solenoid 120 lowers the rod 350 such that the probe 310 rotates back to its starting position. The probe 310 can therefore move when there is no ice or an insufficient amount of ice present. Once the probe 310 can no longer rotate because of the growth of ice, the collar 200 can no longer hit the contact sensor 190. The control system 28 then shuts down the compressor motor 24. By using the circular probe 310, the ice bank detector 300 can detect ice growth over a large area of the ice water bath tank 14. Ice growth at any area along the probe 310 is sufficient to prevent the probe 310 from rotating and therefore cause the compressor motor 24 to shut down.

Figure 6:
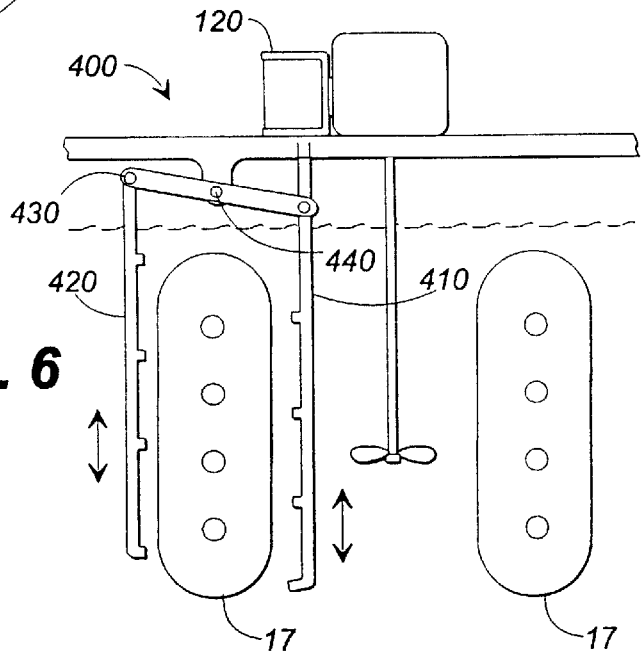
FIG. 6 is a perspective view of an alternative embodiment of the present invention showing dual ice bank probes.

FIG. 6 shows a further embodiment of the present invention. This figure shows an ice bank detector 400 using a first probe 410, a second probe 420, and a linkage 430 connecting the two probes 410, 420. In this embodiment, the first probe 410 is connected to the solenoid 120 in a manner similar to the first embodiment of FIG. 3, i.e., the solenoid 120 and the contact sensor 190 are mounted within the frame 170 with the first probe 410 ending with the collar 200. The first probe 410 is also connected to the linkage 430 for pivotal rotation therewith. Likewise, the second probe 420 is connected to the linkage 430 for pivotal rotation therewith. The linkage 430 is mounted to a pivot 440 for rotation thereabout.

In use, the solenoid 120 periodically lifts the first probe 410. This movement also causes the linkage 430 to rotate about the pivot 440 and thereby lower the second probe 420. Likewise, when the solenoid 120 lowers the first probe 410, the linkage 430 rotates back about the pivot 440 and lifts the second probe 420. In this fashion, the ice bank detector 400 can detect ice growth on either side of the evaporator coils 16 or the evaporator plates 230. Ice growth on either side of the evaporator coils 16 or the evaporator plates 230 is sufficient to prevent the probes 410, 420 from moving and therefore causes the compressor motor 24 to shut down.

Figure 7:
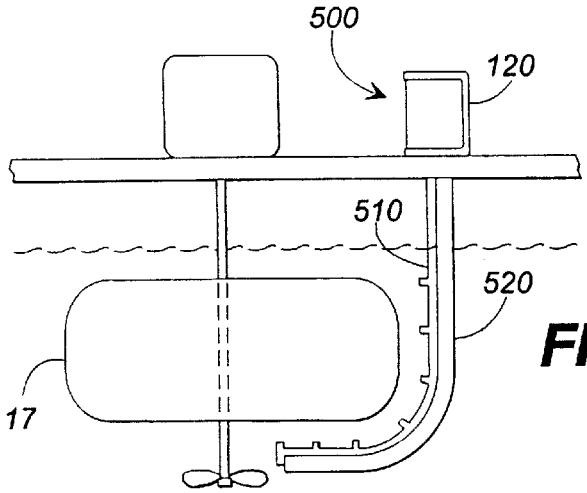
FIG. 7 is a perspective view of an alternative embodiment of the present invention showing a flexible ice bank probe.

FIG. 7 shows a further embodiment of the present invention. This figure shows an ice bank detector 500. The ice bank detector 500 includes a curved probe 510 positioned within a curved jacket 520. The ice bank detector 500 works in a similar manner to that shown in the first embodiment of FIG. 3, i.e., the solenoid 120 and the contact sensor 190 are mounted within the frame 170 with the probe 510 ending with the collar 200. In this embodiment, the probe 510 is made of a flexible plastic material, such as polypropylene or nylon. Because the probe 510 is flexible, the probe 510 can extend vertically downward along the evaporator coils 16 or the evaporator plates 230 and then extend horizontally along the bottom of the ice water bath tank 14. In fact, the probe could encircle the entire ice bank 17. The ice bank detector 500 can therefore determine ice growth at both the bottom and the sides of the ice bank 17. Ice growth on either the side or the bottom of the evaporator coils 16 or the evaporator plates 230 is sufficient to prevent the probe 510 from moving and therefore causes the compressor motor 24 to shut down.

It should be understood that the forgoing relates only to the preferred embodiments of the present invention and that numerous changes may be made herein without departing from the spirit and scope of the invention as defined by the following claims.

I claim:

1. An ice detector for an ice water tank comprising an evaporator system operated by a compressor to promote the growth of ice therein, said detector comprising:

a device for providing reciprocating motion; and a probe connected to said device, said probe positioned within said ice water tank;

said probe comprising an elongated member extending in a direction substantially parallel to said evaporator system and a plurality of members extending towards said evaporator system, said probe capable of reciprocating movement within said ice water tank until a predetermined amount of ice grows adjacent to said probe.

2. The ice detector of claim 1, wherein said plurality of members extending towards said evaporator system are positioned along said elongated member.

3. The ice detector of claim 1, wherein said probe comprises a plurality of spokes extending from said elongated member to an outer hub.

4. The ice detector of claim 5, wherein said plurality of members extending towards said evaporator system are positioned on said plurality of spokes and said outer hub.

5. The ice detector of claim 1, wherein said plurality of members extending towards said evaporator system comprise a plurality of flanges.

6. The ice detector of claim 1, wherein said device comprises an electrical device.

7. The ice detector of claim 6, wherein said electrical device comprises a solenoid.

8. The ice detector of claim 6, further comprising a contact sensor positioned adjacent to said probe for contact therewith.

9. The ice detector of claim 8, wherein said contact sensor is in communication with said compressor such that said compressor remains operative when said probe contacts said contact sensor during said reciprocating movement, and such that said compressor shuts down when said probe fails to contact said contact sensor because said predetermined amount of ice has grown adjacent to said probe.

10. The ice detector of claim 8, wherein said probe moves between a first position in contact with said contact sensor and a second position spaced a predetermined distance from said contact sensor.

11. The ice detector of claim 10, wherein said contact sensor is in communication with said compressor such that said compressor shuts down when said probe contacts said contact sensor at said first position but fails to travel to said second position because said predetermined amount of ice has grown adjacent to said probe.

12. The ice detector of claim 6, wherein said probe comprises a collar and said collar connects said probe to said electrical device.

13. The ice detector of claim 12, wherein said collar comprises a contact flange for contacting said contact sensor.

14. The ice detector of claim 1, wherein said probe comprises a first probe connected to said device and positioned on a first side of said evaporator system, a linkage connected to said first probe, and an second probe connected to said linkage and positioned on a second side of said evaporator system.

15. The ice detector of claim 1, wherein said probe comprises a substantially rigid material.

16. The ice detector of claim 1, wherein said probe comprises a flexible material.

17. The ice detector of claim 16, wherein said elongated member further extends in a direction substantially perpendicular to said evaporator system.

18. The ice detector of claim 1, wherein said probe is positioned within said ice water tank at a predetermined position from said evaporator system.

19. An ice detector for an ice water bath tank comprising an evaporator system operated by a compressor to promote the growth of ice therein, said detector comprising:

a solenoid;

a probe;

said probe comprising at least one member extending in a direction parallel to said evaporator system and a plurality of second members extending in a direction substantially perpendicular to said evaporator system;

said probe mounted to said solenoid such that said solenoid cycles said probe in a first direction and a second direction; and a contact sensor positioned adjacent to said probe such that said probe contacts said sensor during said cycling in the absence of a predetermined amount of ice adjacent to any of said plurality of second members of said probe and fails to contact said sensor during said cycling in the presence of a predetermined amount of ice adjacent to said probe.

20. An improved refrigeration system for a beverage dispenser, comprising:

an ice water bath tank;

a evaporator system positioned within said ice water tank to promote the growth of ice;

said evaporator system powered by a compressor;

an ice probe positioned within said ice water bath tank;

said ice probe comprising at least one member extending in a direction parallel to said evaporator system and a plurality of second members extending in a direction substantially perpendicular to said evaporator system; and means for controlling said compressor such that said compressor is deactivated when ice builds up adjacent to said ice probe.

21. The improved refrigeration system of claim 20, wherein said evaporator system comprises a plurality of evaporator coils.

22. The improved refrigeration system of claim 20, wherein said evaporator system comprises one or more evaporator plates.

23. A method for detecting the buildup of ice in an ice bank comprising a plurality of evaporator tubes or plates operated by a compressor and positioned within a water tank, said method comprising the steps of:

placing an ice probe within said water tank adjacent to one or more of said plurality of said evaporator tubes or plates, said ice probe comprising a plurality of members positioned thereon;

cycling said ice probe between a first and a second position in reciprocating motion;

determining if said ice probe completed said cycling step;

running said compressor if said cycling step is completed; and stopping said compressor if said cycling step is not completed because any of said probe members are embedded in the ice.

24. The improved refrigeration system of claim 22, wherein said contact sensor is in communication with said compressor such that said compressor remains operative when said ice probe contacts said contact sensor during said reciprocating movement, and such that said compressor shuts down when said ice probe fails to contact said contact sensor.

25. The improved refrigeration system of claim 24, wherein said ice probe moves between a first position in contact with said contact sensor and a second position spaced a predetermined distance from said contact sensor.

26. The improved refrigeration system of claim 20, wherein said ice probe comprises reciprocating movement within said ice water bath tank.

27. The improved refrigeration system of claim 26, further comprising a contact sensor positioned adjacent to said ice probe for contact therewith.

* * * * *